US011084643B2

(12) United States Patent
Leiberman

(10) Patent No.: US 11,084,643 B2
(45) Date of Patent: Aug. 10, 2021

(54) INFLATABLE PACKAGING STRUCTURE AND METHOD FOR USE THEREOF

(71) Applicant: Aeris Protective Packaging Inc., Saint-Laurent (CA)

(72) Inventor: Michael Leiberman, Montreal (CA)

(73) Assignee: Aeris Protective Packaging, Inc., Saint-Laurent (CA)

( * ) Notice: Subject to any disclaimer, the term of this patent is extended or adjusted under 35 U.S.C. 154(b) by 0 days.

(21) Appl. No.: 16/699,859

(22) Filed: Dec. 2, 2019

(65) Prior Publication Data

US 2020/0198866 A1 Jun. 25, 2020

Related U.S. Application Data

(60) Provisional application No. 62/783,169, filed on Dec. 20, 2018.

(51) Int. Cl.
*B65D 81/05* (2006.01)
*B65D 85/30* (2006.01)

(52) U.S. Cl.
CPC ..... *B65D 81/052* (2013.01); *B65D 85/30* (2013.01); *B65D 2585/6837* (2013.01)

(58) Field of Classification Search
CPC .... B65D 81/052; B65D 81/051; B65D 81/05; B65D 85/30; B65D 2585/6837
USPC ..... 206/522, 576, 521, 453, 454
See application file for complete search history.

(56) References Cited

U.S. PATENT DOCUMENTS 8,777,009 B2 * 7/2014 Nakase ..... B65D 81/113 206/454
2004/0163991 A1 * 8/2004 Koyanagi ..... B65D 81/052 206/521
2005/0263425 A1 * 12/2005 Tanaka ..... B65D 81/052 206/522

* cited by examiner

*Primary Examiner* — Steven A. Reynolds
(74) *Attorney, Agent, or Firm* — Guy Levi; The IP Law Firm of Guy Levi, LLC

(57) ABSTRACT

An inflatable packaging structure, including at least one end panel made of a plurality of layers of thermoplastic material and arranged along a longitudinal axis, the at least one end panel includes a plurality of fluid chambers arranged perpendicularly to the longitudinal axis, whereas a one-way check valve is incorporated into at least one of the plurality of fluid chambers, an air supply line, configured to commonly communicate with each of the one-way check valves to supply fluid into the fluid chambers and a plurality of weld lines formed through at least two of the plurality of layers of thermoplastic material and configured to form at least two openings within the at least one end panel when the fluid is supplied into the plurality of fluid chambers.

18 Claims, 14 Drawing Sheets

INFLATABLE PACKAGING STRUCTURE AND METHOD FOR USE THEREOF

FIELD OF THE INVENTION

The present invention relates to a packaging structure, and more particularly, to an inflatable packaging structure that is adapted for protection of all parts of an electronic device and having improved shock absorbing capabilities.

BACKGROUND OF THE INVENTION

During a product shipping, foam, bubble wrap or cardboard are usually used to protect electronics from damage during handling and transportation.

An inflatable packaging structure is known in the art and includes a plurality of fluid containers, which contains liquid or gas, such as air, which is sealingly entrapped within each of the fluid containers by means of a one-way check-valve. There are multiple advantages in such inflatable packaging structures over the foam, bubble wrap or cardboard packaging, such as for example: reduced storage space is required for the inflatable packaging when it is stored in a non-inflated state; inflatable packaging structure does not produce any contaminations or debris; suspension or impact absorbance is increased in inflatable packaging structures, as compared with other known types of packaging, such as foam, bubble wrap or cardboard, this is partially due to the fact that the protected device, such as a laptop, computer screen or TV screen, is spaced from the walls of the box in which it is being delivered, thus preventing direct impact to be applied upon.

SUMMARY OF THE INVENTION

The present invention seeks to provide an improved inflatable packaging structure.

There is thus provided in accordance with an embodiment of the present invention an inflatable packaging structure, including at least one end panel made of a plurality of layers of thermoplastic material and arranged along a longitudinal axis, the at least one end panel includes a plurality of fluid chambers arranged perpendicularly to the longitudinal axis, whereas a one-way check valve is incorporated into at least one of the plurality of fluid chambers; an air supply line, configured to commonly communicate with each of the one-way check valve s to supply fluid into the fluid chambers, and a plurality of weld lines formed through at least two of the plurality of layers of thermoplastic material and configured to form at least two openings within the at least one end panel when the fluid is supplied into the plurality of fluid chambers.

Preferably, at least one of the plurality of weld lines is adapted to join two of the plurality of layers of thermoplastic material. Alternatively, at least one of the plurality of weld lines is adapted to join four of the plurality of layers of thermoplastic material.

Still preferably, the two openings are directed perpendicularly with respect to each other. Alternatively, two out of the at least two openings are facing the same direction.

Preferably, at least two of the weld lines are perpendicular to each other.

Optionally, the inflatable packaging structure also includes a second end panel, which is identical to the at least one panel. Further optionally, the inflatable packaging structure also includes a foot panel having an opening. Preferably, the foot panel is adapted to be inserted between two end panels.

In accordance with an embodiment of the present invention, a fluid buffer chamber is formed between the at least two openings.

Preferably, at least one of the openings has an at least partially rectangular cross-section.

Further preferably, a first opening of the end panel is adapted for receiving a portion of a screen thereinto. Still further preferably, a second opening, which is perpendicular to the first opening, is adapted for receiving a keyboard thereinto. Yet further preferably, a third opening, which is facing the same direction as the first opening is adapted to receive an electrical cord thereinto. Still further preferably, the opening of the foot panel is adapted to receive a base of a screen thereinto.

In accordance with an embodiment of the present invention, an inflatable packaging structure, comprising at least one end panel made of a plurality of layers of thermoplastic material and arranged along a longitudinal axis; the at least one end panel includes a plurality of fluid chambers arranged perpendicularly to the longitudinal axis, whereas a one-way check valve is incorporated into at least one of the plurality of fluid chambers; an air supply line, configured to commonly communicate with each of the one-way check valves to supply fluid into the fluid chambers; and a plurality of weld lines formed through at least two of the plurality of layers of thermoplastic material and configured to form at least two portions, whereas one of the at least two portions is pivotable about one of the weld lines when the fluid is supplied into the plurality of fluid chambers.

Preferably, the plurality of weld lines are configured to form at least two openings within the at least one end panel when the fluid is supplied into the plurality of fluid chambers. Further preferably, the two openings are directed perpendicularly with respect to each other. Still further preferably, In accordance with an embodiment of the present invention, an inflatable packaging kit, comprising at least two end panels and a foot panel, each made of a plurality of layers of thermoplastic material and arranged along a longitudinal axis, wherein each of the at least two end panels and the foot panel includes a plurality of fluid chambers arranged perpendicularly to the longitudinal axis, whereas a one-way check valve is incorporated into at least one of the plurality of fluid chambers; an air supply line, configured to commonly communicate with each of the one-way check valves to supply fluid into the fluid chambers; and a plurality of weld lines formed through at least two of the plurality of layers of thermoplastic material; the at least two end panels and the foot panel are configured to be inflated and the foot panel is adapted to be inserted between the at least two end panels when inflated, thereby positioning the at least two end panels with respect to a packaging box.

Preferably, the plurality of weld lines are configured to form at least two openings within at least one of the at least two end panels when the fluid is supplied into the plurality of fluid chambers, and wherein the two openings are directed perpendicularly with respect to each other.

BRIEF DESCRIPTION OF THE DRAWINGS

The present invention will be understood and appreciated more fully from the following detailed description, taken in conjunction with the drawings in which.

DETAILED DESCRIPTION OF EMBODIMENTS OF THE INVENTION

The present invention preferably includes an inflatable packaging structure including preferably two identical end panels adapted to protect the sides of a screen and optionally a foot panel that is adapted to be disposed between the two end panels. The end panels preferably include at least one accessory pocket to provide an all-in-one packaging structure and an increased shock absorption to enable better protection of the protected device, such as a laptop, computer screen or TV screen. The inflatable packaging structure is also configured to be adjustable to fit various sizes of the protected device.

Figure 1A:
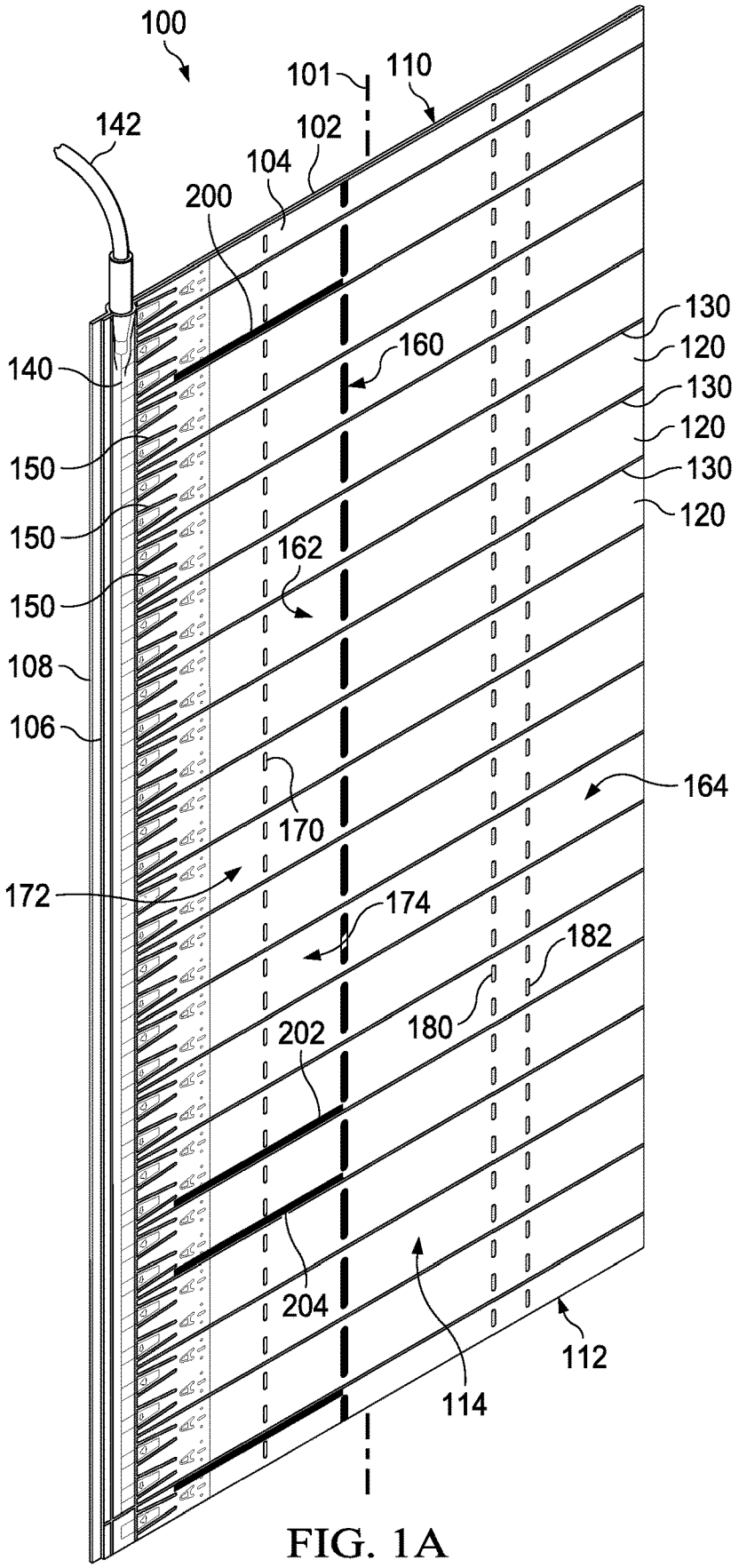
FIGS. 1A & 1B are a simplified pictorial and side view illustrations of an end panel shown in a non-inflated operative orientation, the end panel forming part of an inflatable packaging structure being constructed and operative in accordance with an embodiment of the present invention.
Figure 1B:
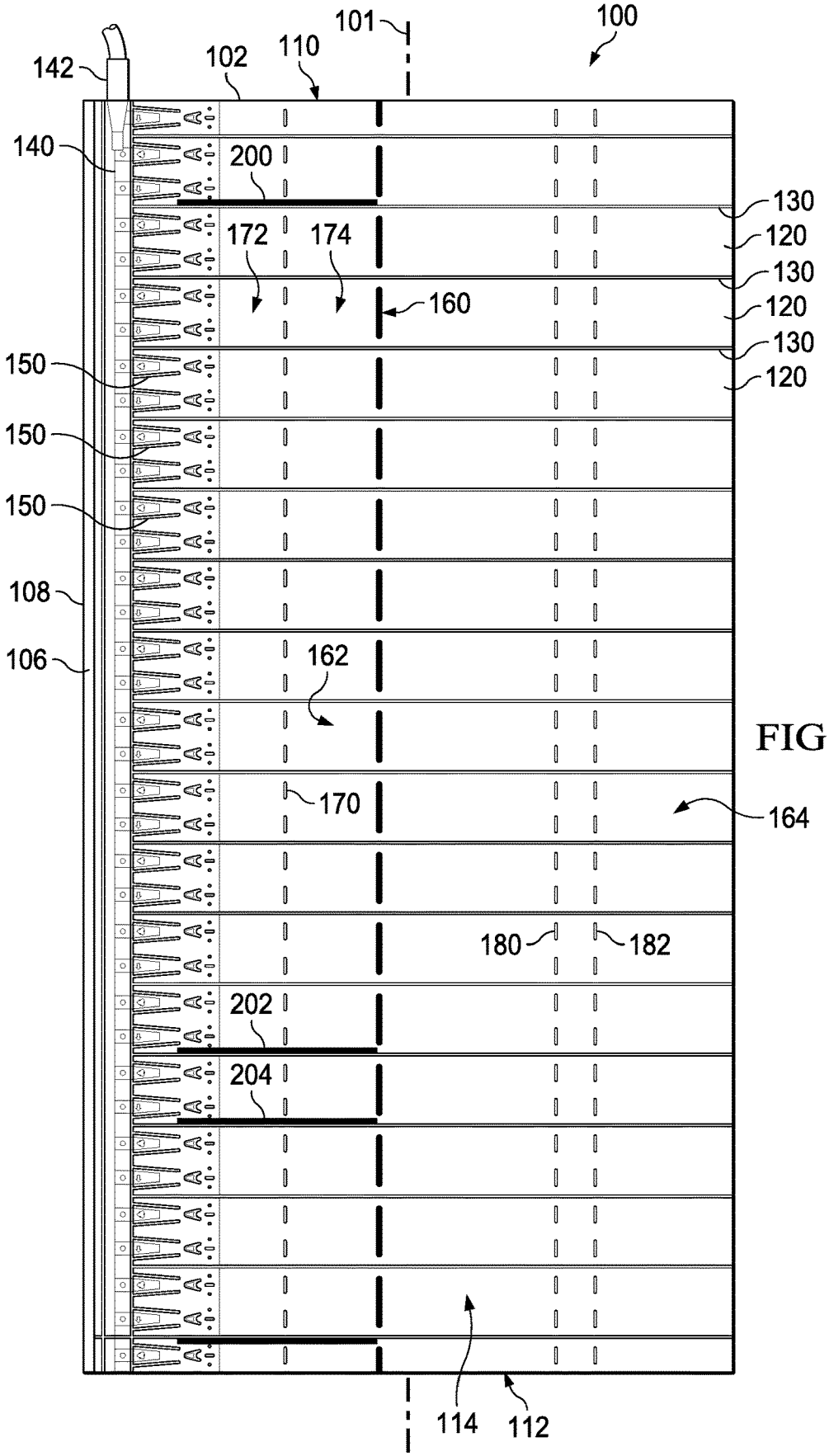

Reference is now made to FIGS. 1A & 1B, which are a simplified pictorial and side view illustrations of an end panel shown in a non-inflated operative orientation, the end panel forming part of an inflatable packaging structure being constructed and operative in accordance with an embodiment of the present invention. Reference is now additionally made to FIGS. 3A-3D, which are respective simplified pictorial, front view, side view and top view illustrations of the end panel of FIGS. 1A & 1B, shown in an inflated operative orientation.

FIGS. 1A & 1B show a respective pictorial and side view illustrations of an end panel 100, shown in a non-inflated operative orientation, whereas FIGS. 3A-3D show various illustrations of the end panel 100 in an inflated orientation.

The end panel is made of a thermoplastic material, such as polyethylene and is arranged along a longitudinal axis 101. It is noted that the end panel 100 is preferably of a rectangular shape and is composed of two thermoplastic films 102 and 104, which are heat-sealingly bonded along the perimeter of the rectangle, such as to form two parallel edges 106 and 108, which extend in parallel to the longitudinal axis 101 and two parallel edges 110 and 112, which extend perpendicularly with respect to longitudinal axis 101.

Figure 3A:
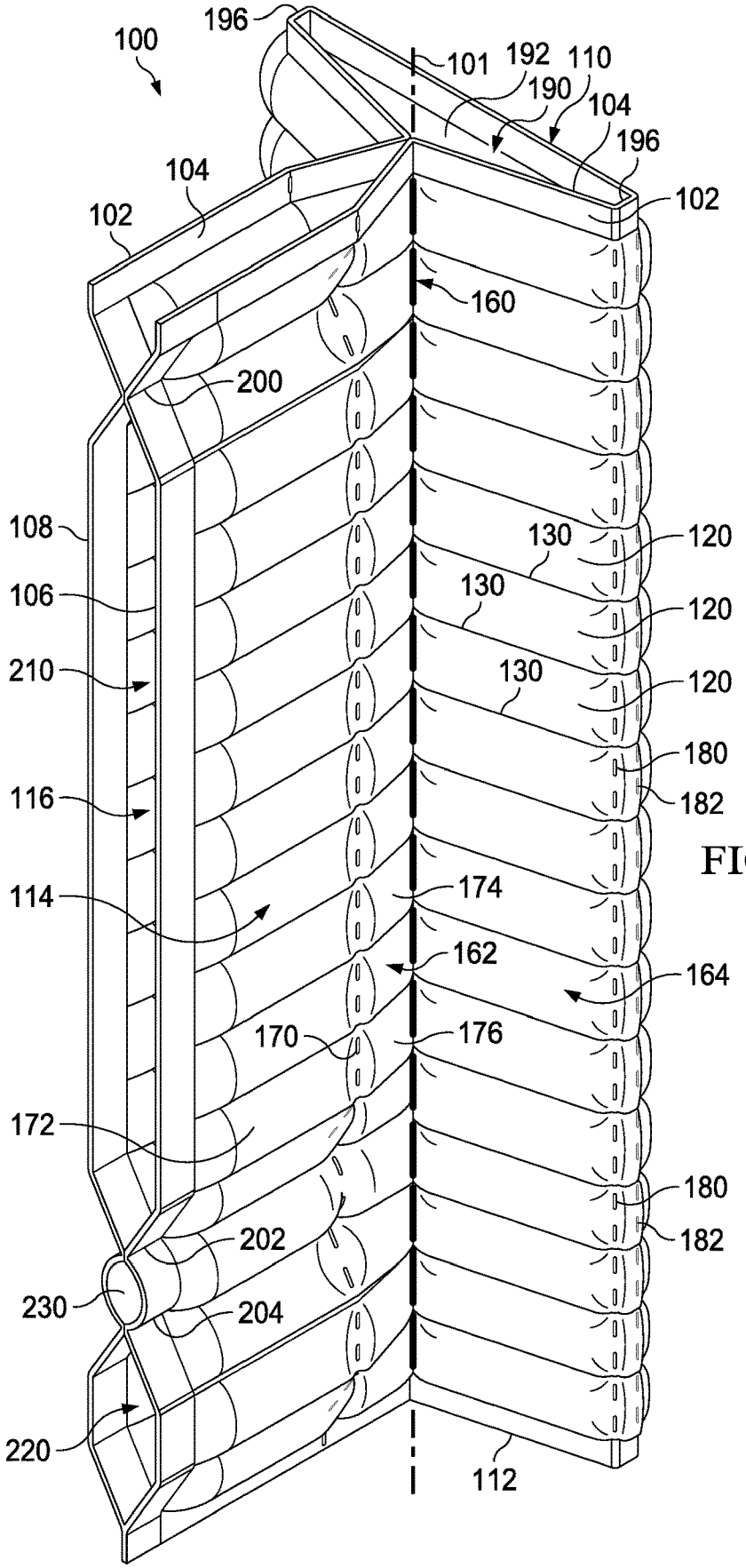
FIGS. 3A-3D are respective simplified pictorial, front view, side view and top view illustrations of the end panel of FIGS. 1A & 1B, shown in an inflated operative orientation.
Figure 3B:
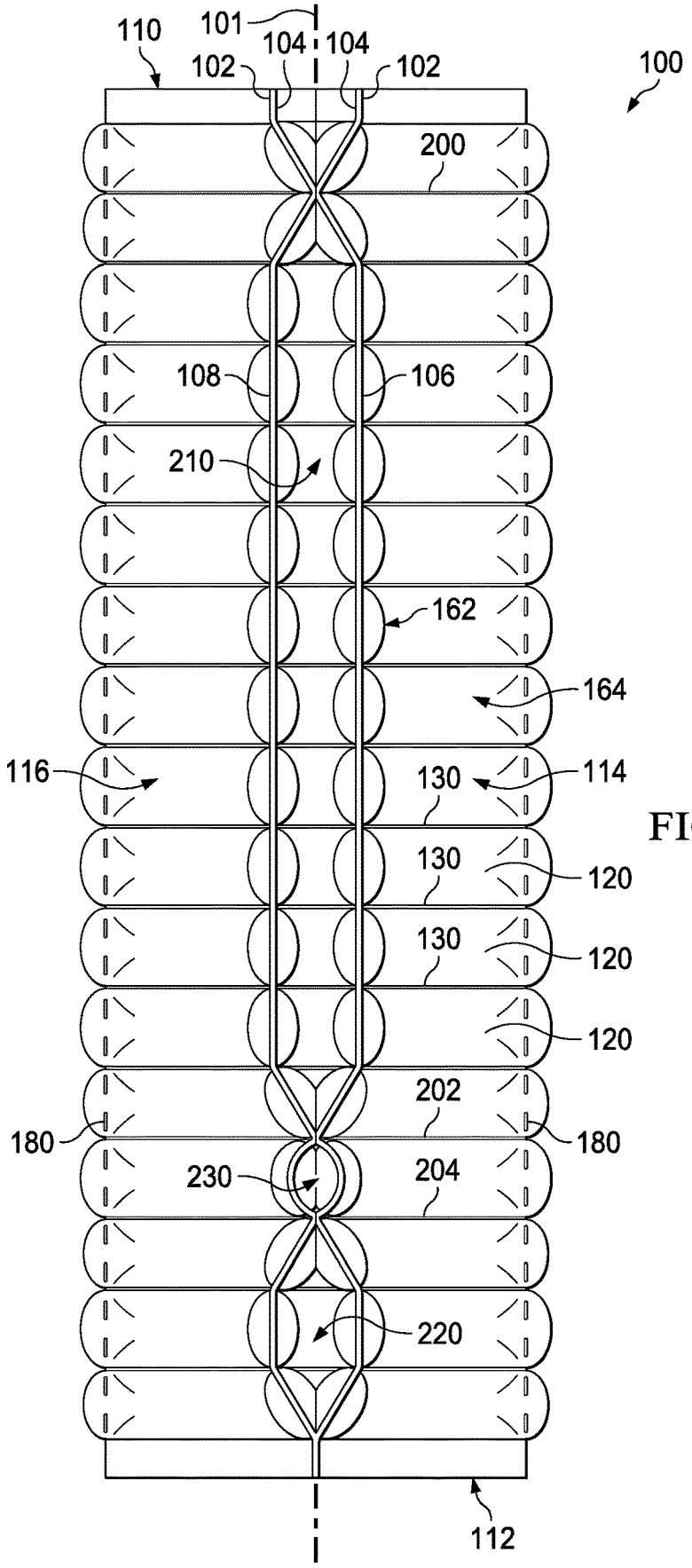
Figure 3C:
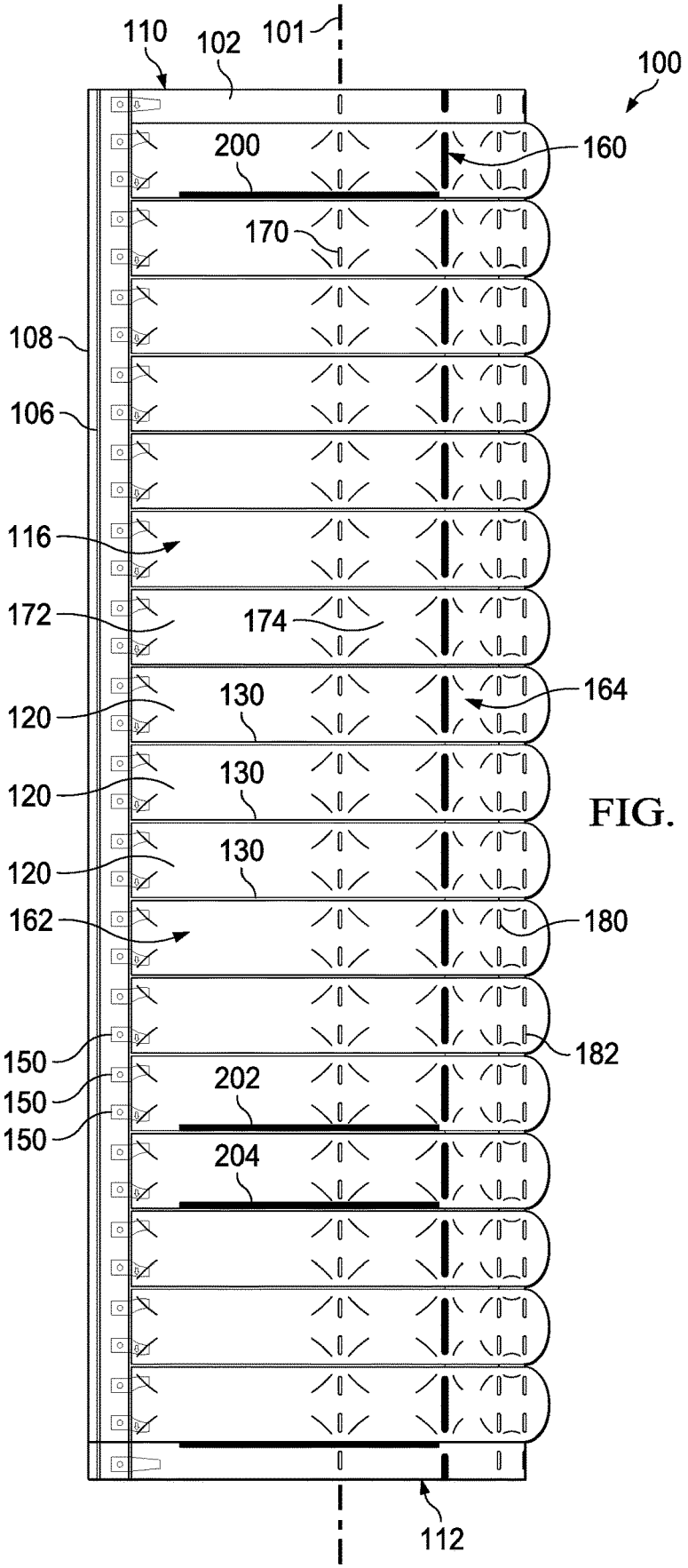

It is seen particularly in FIG. 3A that the two thermoplastic films 102 and 104 are folded over, such that edges 106 and 108 are aligned with respect to each other and two preferably structurally identical portions 114 and 116 of the end panel 100 are formed.

A plurality of air chambers 120 is formed between layers 102 and 104 of the end panel 100. It is seen that each of the air chambers 120 is oriented perpendicularly with respect to longitudinal axis 101 and extends from edge 106 to edge 108. Each air chamber 120 is disposed adjacent to another, and the plurality of air chambers 120 extends along the entire longitudinal extent provided between edge 110 and edge 112 of the end panel 100. Each of the air chambers 120 is separated from another by means of a heat seal line 130.

It is seen particularly in FIGS. 1A & 1B that an air supply line 140 is provided along edge 106 of the end panel 100 and a filling valve 142 is incorporated at one side of the air supply line 140. A one-way check valve 150 is preferably mounted within each of the air chambers 120 and is configured to enable air passage from the air supply line 140 into the inner volume of each of the respective air chambers 120 and to prevent air passage from the inner volume of each of the respective air chambers 120.

It is noted that the air is configured to be supplied to the air supply line 140 from an exterior source, such as a pump, through the filling valve 142, and further distributed through the plurality of one-way check valve s 150 into each of the plurality of air chambers 120 of the end panel 100 in order to inflate the end panel 100, due to the fact that the air supply line 140 is commonly communicates with all of the one-way check valve s 150.

It is noted that any fluid, i.e. liquid or gas, can alternatively be used for inflation of the end panel 100.

Portions 114 and 116 of the end panel 100 as described hereinabove differ only in that portion 114 includes the air supply line 140, filling valve 142 and the plurality of one-way check valve s 150, whereas portion 116 does not include these elements.

It is noted that each of the air chambers 120 operate independently due to the fact that each of the air chambers 120 is provided with a separate one-way check valve 150. In case one of the air chambers 120 is ruptured, the remaining air chambers remain intact.

It is seen specifically in FIGS. 1A & 1B and FIGS. 3A-3D that a first weld line 160 extends in parallel to longitudinal axis 101 and is configured to attach four layers of thermoplastic films, namely two layers of film 102 and two layers of film 104, thus attaching portions 114 and 116 of the end panel 100 and effectively dividing each portion of the end panel 100 into two functional portions: first receiving portion 162, preferably adapted to receive a side of a screen and second receiving portion 164, preferably adapted to receive a keyboard.

It is noted that the first weld line 160 is composed of a plurality of segments, each segment extends through a portion of each of the air chambers 120, thereby defining the resulting form of the end panel 100 when inflated and at the same time permitting passage of air from the air supply line 140 through the entire length of each of the air chambers 120, extending from edge 106 to edge 108, as mentioned hereinabove.

It is a particular feature of an embodiment of the present invention that a second weld line 170 is formed on each of the first receiving portions 162 of portions 114 and 116 and extends in parallel to longitudinal axis 101 and is configured to attach two layers of thermoplastic films, namely one layer of film 102 and one layer of film 104. The second weld line 170 effectively separates the first receiving portion 162 into two sub-portions: articulating sub-portion 172 and connecting sub-portion 174. It is noted that the second weld line 170 serves as articulation axis for articulating portion 172.

It is noted that the second weld line 170 is composed of a plurality of segments, each segment extends through a portion of each of the air chambers 120, thereby defining the resulting form of the end panel 100 when inflated and at the same time permitting passage of air from the air supply line 140 through the entire length of each of the air chambers 120, extending from edge 106 to edge 108, as mentioned hereinabove.

It is a further particular feature of an embodiment of the present invention that a third weld line 180 and a fourth weld line 182 are formed on each of the second receiving portions 164 of portions 114 and 116 and extend in parallel to longitudinal axis 101. Third and fourth weld lines 180 and 182 are preferably disposed adjacent to each other and both are configured to attach two layers of thermoplastic films, namely one layer of film 102 and one layer of film 104. The third and fourth weld lines 180 and 182 effectively predefine the shape of the second receiving portions 164 in the inflated orientation, as described in more detail hereinbelow.

It is noted that the second weld lines 180 and 182 are also each composed of a plurality of segments, each segment extends through a portion of each of the air chambers 120, thereby defining the resulting form of the end panel 100 when inflated and at the same time permitting passage of air from the air supply line 140 through the entire length of each of the air chambers 120, extending from edge 106 to edge 108, as mentioned hereinabove.

Figure 3D:
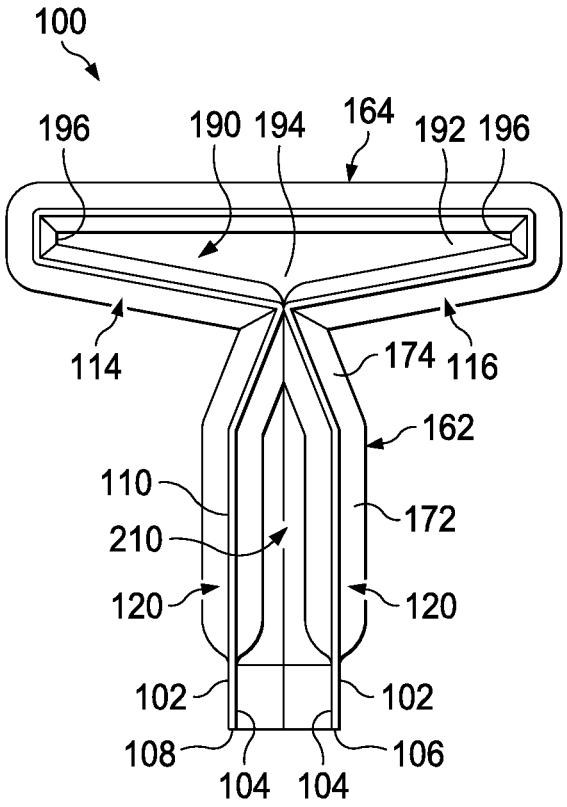

It is specifically seen in FIG. 3D that a first opening 190 is formed between the second receiving portions 164 and extends along an axis parallel to longitudinal axis 101. The shape of the opening 190 is defined by the first weld line 160 and the third and fourth weld lines 180 and 182.

It is a particular feature of an embodiment of the present invention that the cross-section of the first opening 190 includes a generally rectangular portion 192 connected with a generally triangular portion 194. Two parallel faces 196 of the rectangular portion 192 are defined by the distance between the third and the forth weld lines 180 and 182.

It is noted that the first opening 190 extends through the entire length of the end panel 100 from edge 110 to edge 112.

It is seen in FIGS. 1A & 1B and FIGS. 3A-3D that a weld line 200 is formed in proximity of edge 110 of the end panel, but spaced apart by at least one air chamber 120. The weld line 200 extends in parallel to air chamber 120, between two neighboring air chamber 120 and along the length of articulating portion 172. Weld line 200 preferably attaches four layers of thermoplastic film, namely two layers of film 102 and two layers of film 104.

It is a particular feature of an embodiment of the present invention that at least one air chamber 120 on each of the portions 114 and 116 of the end panel 100, which is disposed between weld line 200 and edge 110 of the end panel 100 serves as a buffer air chamber, used to increase shock absorbance and separate the protected device from the walls of the box it is shipped in. Alternatively, the edges 110 of portions 114 and 116 of the end panel 100 can be joined and sealed to each other to form the additional buffer air chamber.

It is seen that the edges 112 of portions 114 and 116 of the end panel 100 are heat sealed together, such that the four layers of thermoplastic film is bonded together along edges 112.

It is further seen in FIGS. 1A & 1B and FIGS. 3A-3D that two spaced apart weld lines 202 and 204 are formed closer to the second sealed edge 112 of the end panel 100.

It is seen that weld line 204 is separated by several air chambers 120 from second sealed edge 112, typically by three air chambers. The weld line 204 extends in parallel to air chamber 120, between two neighboring air chambers 120 and along the length of articulating portion 172. Weld line 204 preferably attaches four layers of thermoplastic film, namely two layers of film 102 and two layers of film 104.

It is further seen that weld line 202 is separated by at least one air chamber 120 from weld line 204 and is disposed farther away from sealed edges 112 than weld line 204. The weld line 202 extends in parallel to air chamber 120, between two neighboring air chambers 120 and along the length of articulating portion 172. Weld lines 202 and 204 also preferably attach four layers of thermoplastic film, namely two layers of film 102 and two layers of film 104.

It is a further particular feature of an embodiment of the present invention that a second opening 210 shaped as a rectangular "O" is formed between weld line 200 and 202 and its depth is defined by the length of the articulating portion 172. Second opening 210 serves for insertion of a side of a screen thereinto. It is particularly seen the size of the second opening is self-adjustable in accordance with the width of the screen due to the articulation capabilities of articulating portions 172. It is seen that the first opening 190 and the second opening 210 are directed perpendicularly with respect to each other. It is noted that the cross-section of the second opening 210 is U-shaped.

It is a still further particular feature of an embodiment of the present invention that a third opening 220 is formed between weld line 204 and the sealed edges 112 of the end panel 100 and its depth is defined by the length of the articulating portion 172. Third opening 220 serves for insertion of accessories, such as an electrical cord thereinto. It is seen that the first opening 190 and the third opening 220 are directed perpendicularly with respect to each other. It is also seen that the third opening 220 faces the same direction as second opening 210

It is a yet further particular feature of an embodiment of the present invention that a buffer air compartment 230 is formed between weld line 204 and weld line 202 and its depth is defined by the length of the articulating portion 172. The buffer air compartment 230 serves for additional increase of shock absorbance and for protection of the accessories inserted into third opening 220. It is noted that addition of such buffer air compartment enables to increase the rigidity of the structure by approximately 5%-6%.

It is a particular feature of an embodiment of the present invention that the end panel 100 has a second opening 210 adapted for receiving a portion of a screen thereinto, and the end panel 100 further has a first opening 190 and a third opening 220, which are integrally formed as part of the end panel 100 and are adapted for insertion of accessories thereinto.

Figure 2A:
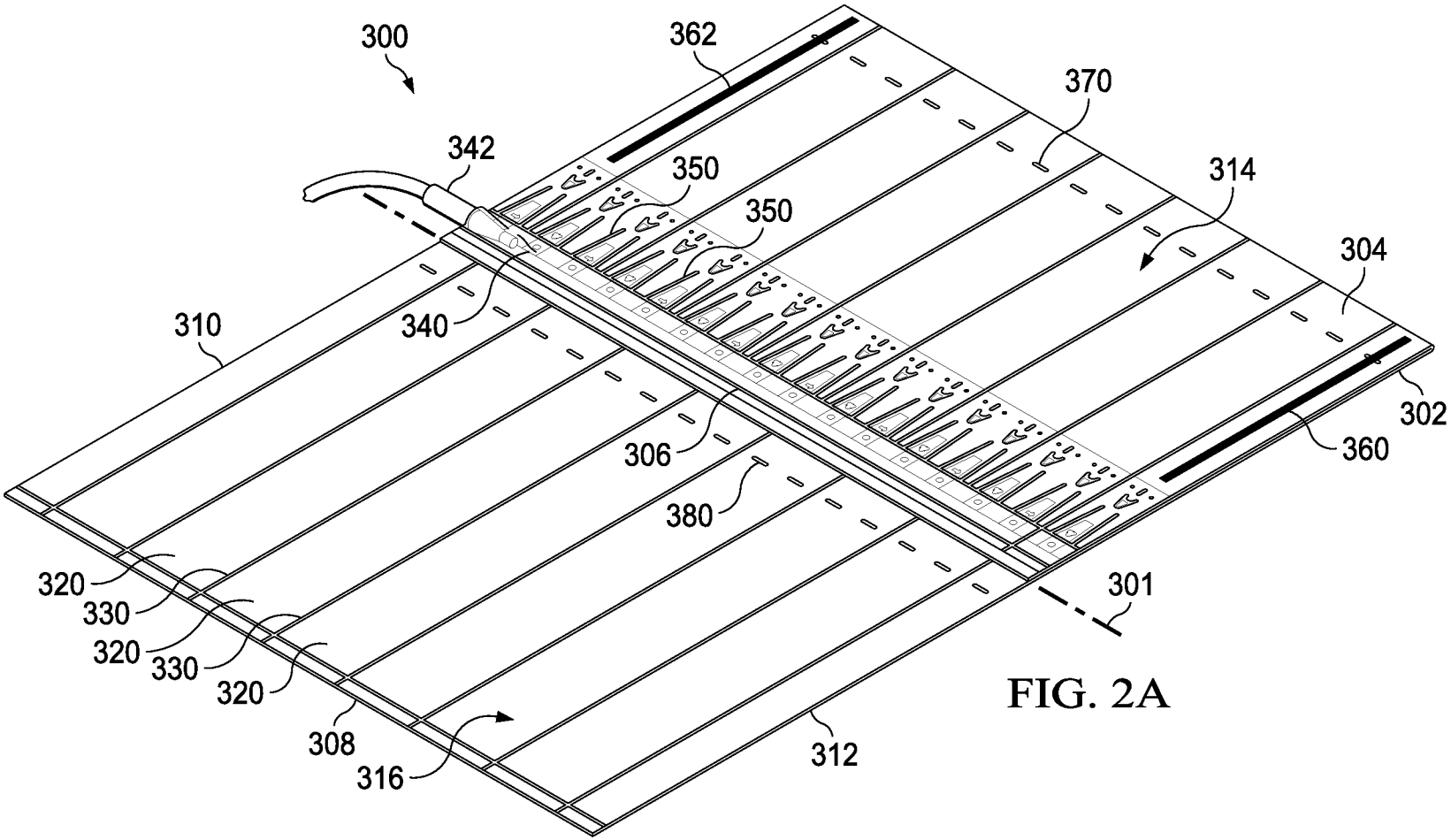
FIGS. 2A & 2B are a simplified pictorial and side view illustrations of a foot panel shown in a non-inflated orientation, the foot panel preferably forming part of the inflatable packaging structure being constructed and operative in accordance with an embodiment of the present invention.
Figure 2B:
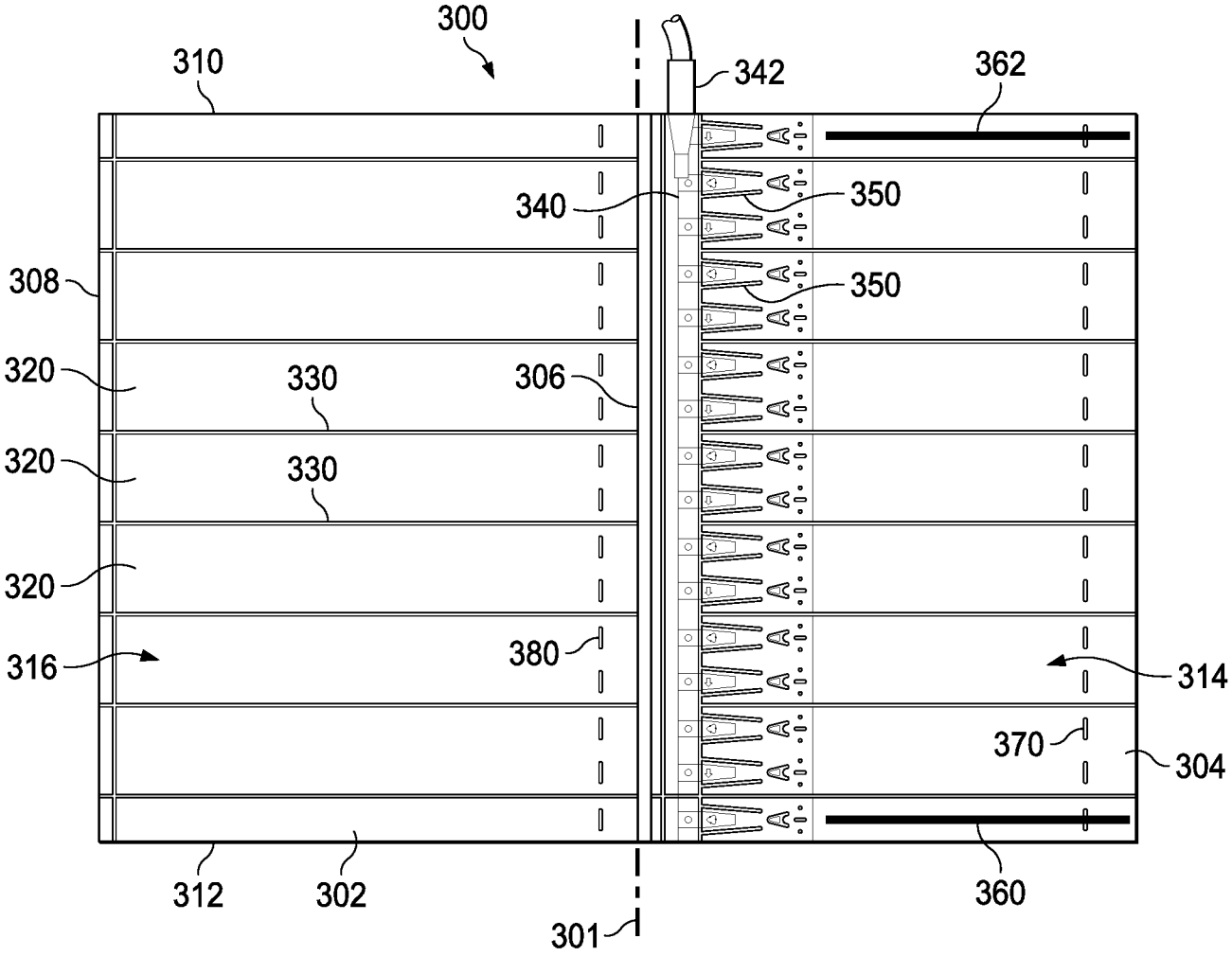

Reference is now made to FIGS. 2A & 2B, which are a simplified pictorial and side view illustrations of a foot panel shown in a non-inflated orientation, the foot panel preferably forming part of the inflatable packaging structure being constructed and operative in accordance with an embodiment of the present invention. Reference is additionally made to FIGS. 4A-4D, which are respective simplified pictorial, front view, back view and sectional illustrations of the foot panel of FIGS. 2A & 2B, shown in an inflated operative orientation, sectional view is being taken along lines D-D in FIG. 4A.

FIGS. 2A & 2B show a respective pictorial and side view illustrations of a foot panel 300, shown in a non-inflated operative orientation, whereas FIGS. 4A-4D show various illustrations of the foot panel 300 in an inflated orientation.

The foot panel is made of a thermoplastic material, such as polyethylene and is arranged along a longitudinal axis 301. It is noted that the foot panel 300 is preferably of a rectangular shape and is composed of two thermoplastic films 302 and 304, which are heat-sealingly bonded along the perimeter of the rectangle, such as to form two parallel edges 306 and 308, which extend in parallel to the longitudinal axis 301 and two parallel edges 310 and 312, which extend perpendicularly with respect to longitudinal axis 301.

Figure 4A:
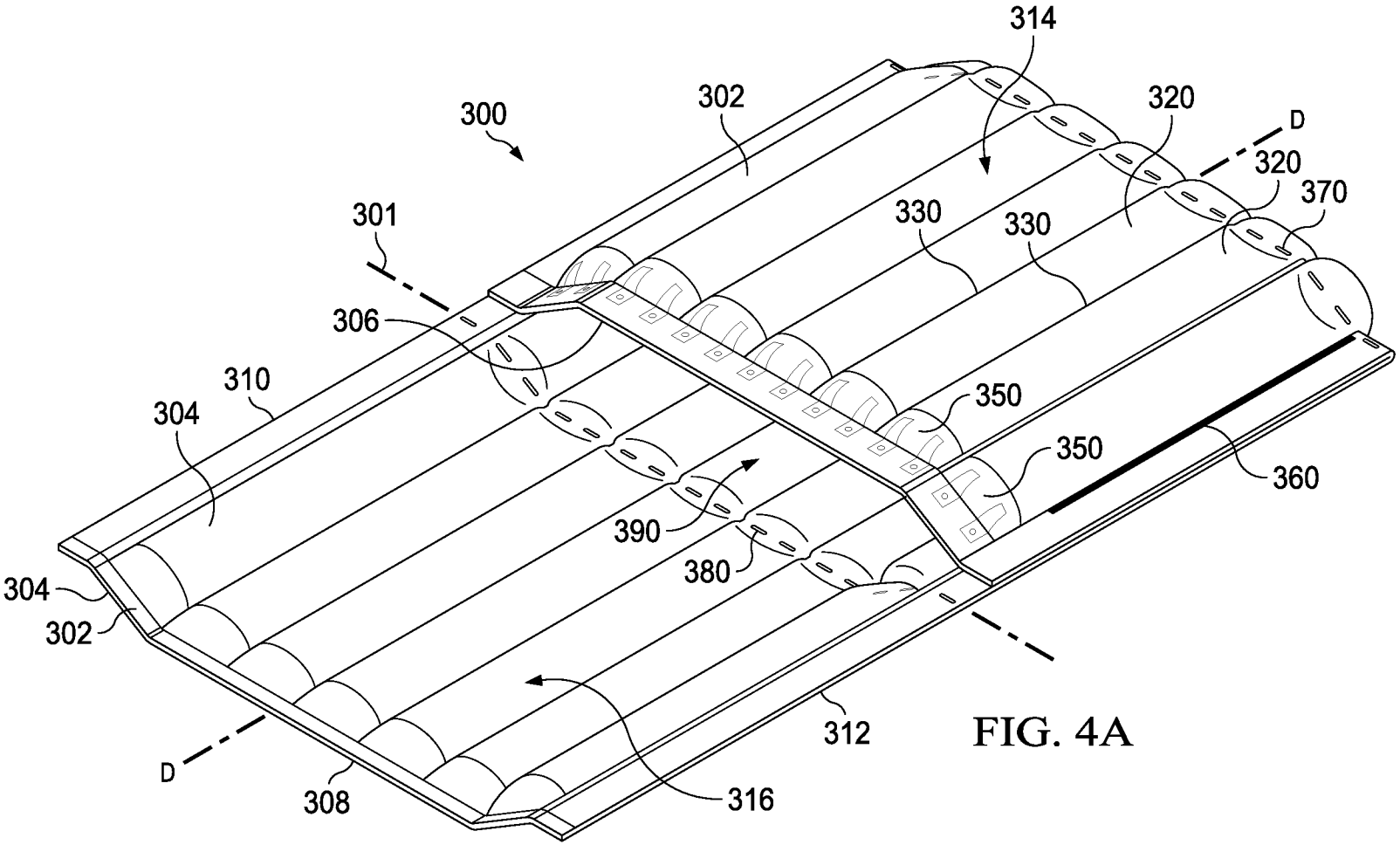
FIGS. 4A-4D are respective simplified pictorial, front view, back view and sectional illustrations of the foot panel of FIGS. 2A & 2B, shown in an inflated operative orientation, sectional view is being taken along lines D-D in FIG. 4A.
Figure 4B:
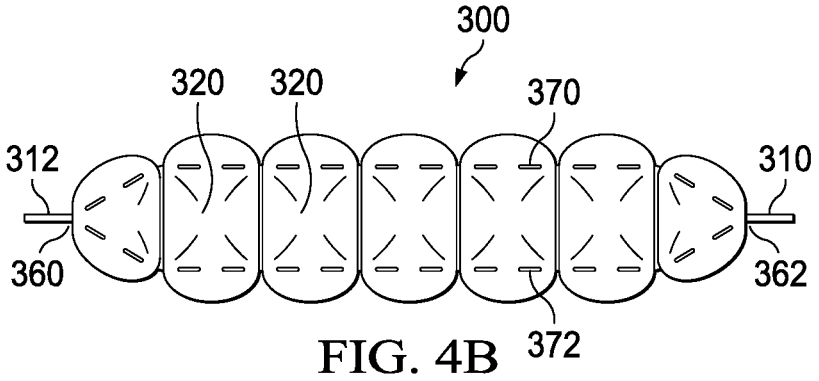

It is seen particularly in FIG. 4A that the two thermoplastic films 302 and 304 are folded over, such that edge 306 is spaced apart from edge 308 thereby forming a short foot panel portion 314 and a long foot panel portion 316.

A plurality of air chambers 320 is formed between layers 302 and 304 of the foot panel 300. It is seen that each of the air chambers 320 is oriented perpendicularly with respect to longitudinal axis 301 and extends from edge 306 to edge 308. Each air chamber 320 is disposed adjacent to another, and the plurality of air chambers 320 extends along the entire longitudinal extent provided between edge 310 and edge 312 of the foot panel 300. Each of the air chambers 320 is separated from another by means of a heat seal line 330.

It is seen particularly in FIGS. 2A & 2B that an air supply line 340 is provided along edge 306 of the foot panel 300 and a filling valve 342 is incorporated at one side of the air supply line 340. A one-way check valve 350 is preferably mounted within each of the air chambers 320 and is configured to enable air passage from the air supply line 340 into the inner volume of each of the respective air chambers 320 and to prevent air passage from the inner volume of each of the respective air chambers 320.

It is noted that the air is configured to be supplied to the air supply line 340 from an exterior source, such as a pump, through the filling valve 342, and further distributed through the plurality of one-way check valve s 350 into each of the plurality of air chambers 320 of the end panel 300 in order to inflate the end panel 300, due to the fact that the air supply line 340 commonly communicates with all of the one-way check valve s 350.

It is noted that each of the air chambers 320 operates independently due to the fact that each of the air chambers 320 is provided with a separate one-way check valve 350. In case one of the air chambers 320 is ruptured, the remaining air chambers remain intact.

It is seen specifically in FIGS. 2A & 2B and FIGS. 4A-4D that edge 312 of portion 316 of the foot panel 300 is heat sealingly joined with edge 312 of portion 314 of the foot panel 300, as indicated by weld line 360. Similarly, edge 310 of portion 316 of the foot panel 300 is heat sealingly joined with edge 310 of portion 314 of the foot panel 300, as indicated by weld line 362.

A pair of weld lines 370 and 372 are formed adjacent the folding area between portions 314 and 316 of the foot panel 300, weld line 370 is formed on portion 314 and weld line 372 is formed on portion 316. The weld lines 370 and 372 extends in parallel to longitudinal axis 301 from edge 310 to edge 312 and are configured to attach two layers of thermoplastic films, namely one layer of film 302 and one layer of film 304. The weld lines 370 and 372 effectively predefine the shape of the opening formed in the foot panel 300 in the inflated operative orientation.

An additional weld line 380 is formed at a generally intermediate location of portion 314 of the foot panel 300 and extends in parallel to longitudinal axis 301 from edge 310 to edge 312 and is configured to attach two layers of thermoplastic films, namely one layer of film 302 and one layer of film 304. Weld line 380 is used as a hinge to allow portion 316 to fold up around a base of a screen when the screen is positioned within a box.

It is noted that the weld lines 370, 372 and 380 are composed of a plurality of segments, each segment extends through a portion of each of the air chambers 320, thereby defining the resulting form of the foot panel 300 when inflated and at the same time permitting passage of air from the air supply line 340 through the entire length of each of the air chambers 320, extending from edge 306 to edge 308, as mentioned hereinabove.

Figure 4C:
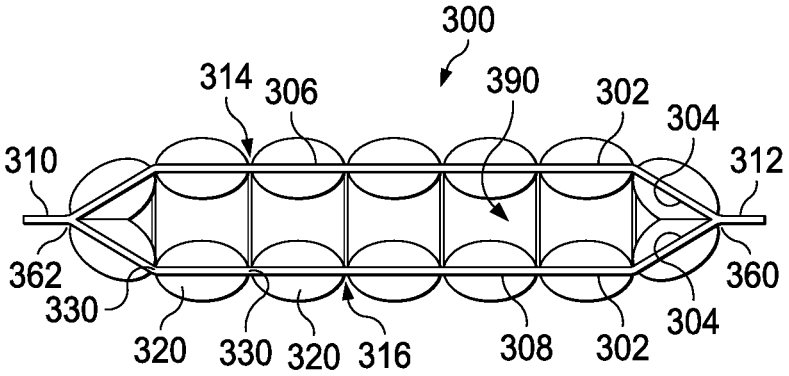
Figure 4D:
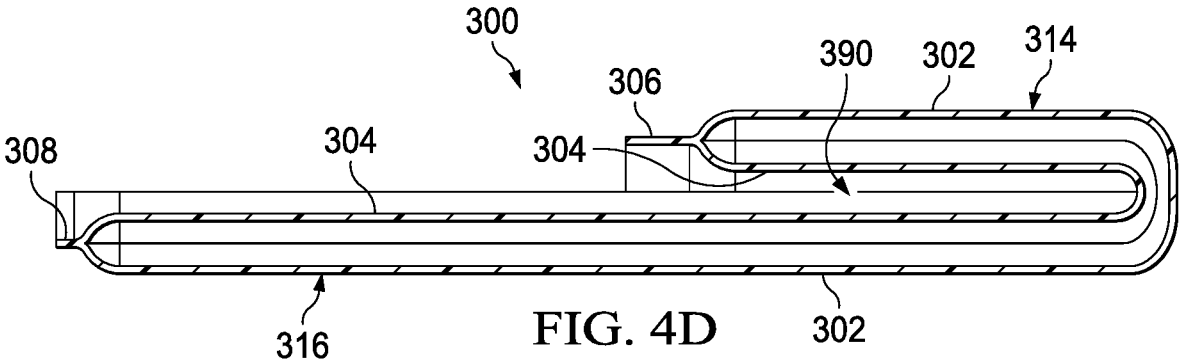

It is specifically seen in FIGS. 4A, 4C and 4D that an opening 390 is formed between the first and second portions 314 and 316 of the foot panel 300. The opening extends along an axis parallel to longitudinal axis 301 from edge 310 to edge 312. The depth of the opening is defined by the length of portion 316 of the foot panel 300. The shape of the opening 390 is defined by distance between weld lines 370 and 372, the further the weld line 370 and 372 are from each other, the wider is the opening 390. Opening 390 is configured for partial insertion of the base of a screen thereinto.

Figure 5A:
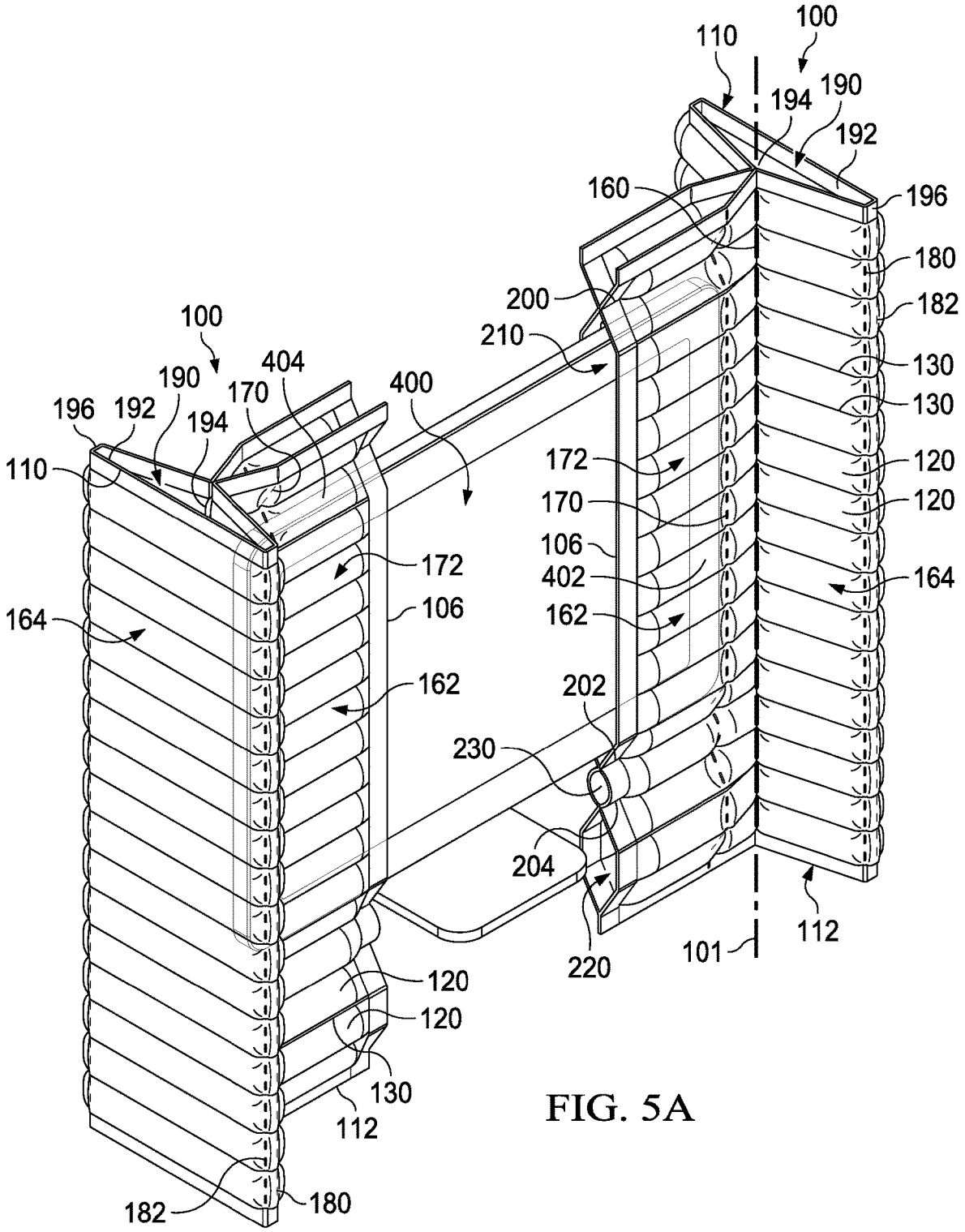
FIGS. 5A & 5B are respective simplified pictorial and top view illustrations showing a screen protected by two preferably identical end panels of FIGS. 3A-3D, shown in an inflated operative orientation.
Figure 5B:
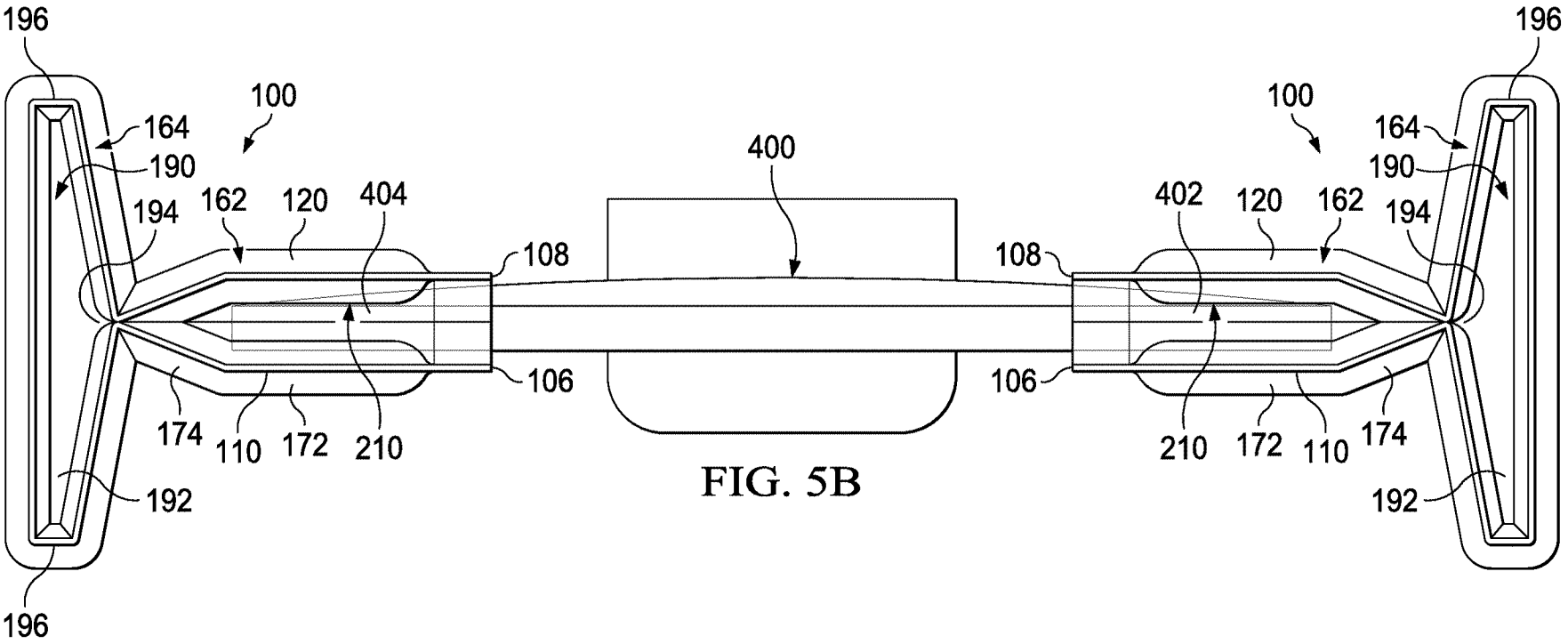

Reference is now made to FIGS. 5A & 5B, which are respective simplified pictorial and top view illustrations showing a screen protected by two preferably identical end panels of FIGS. 3A-3D, shown in an inflated operative orientation.

It is seen in FIGS. 5A & 5B that a screen 400 having a first side 402 and a second side 404 partially received by two identical end panels 100. The first side 402 is received within second opening 210 of a first end panel 100 and the second side 404 is received within second opening 210 of a second end panel 100.

It is a particular feature of an embodiment of the present invention that articulating portions 172 of end panels 100 are adapted to pivot about articulation axis 170 and adjust the packaging structure to the width of the screen 400, such that opening 210 closely corresponds to the shape of the received screen 400.

It is noted that in the operative orientation shown in FIGS. 5A & 5B the first opening 190 and the third opening 220 are empty.

Figure 6:
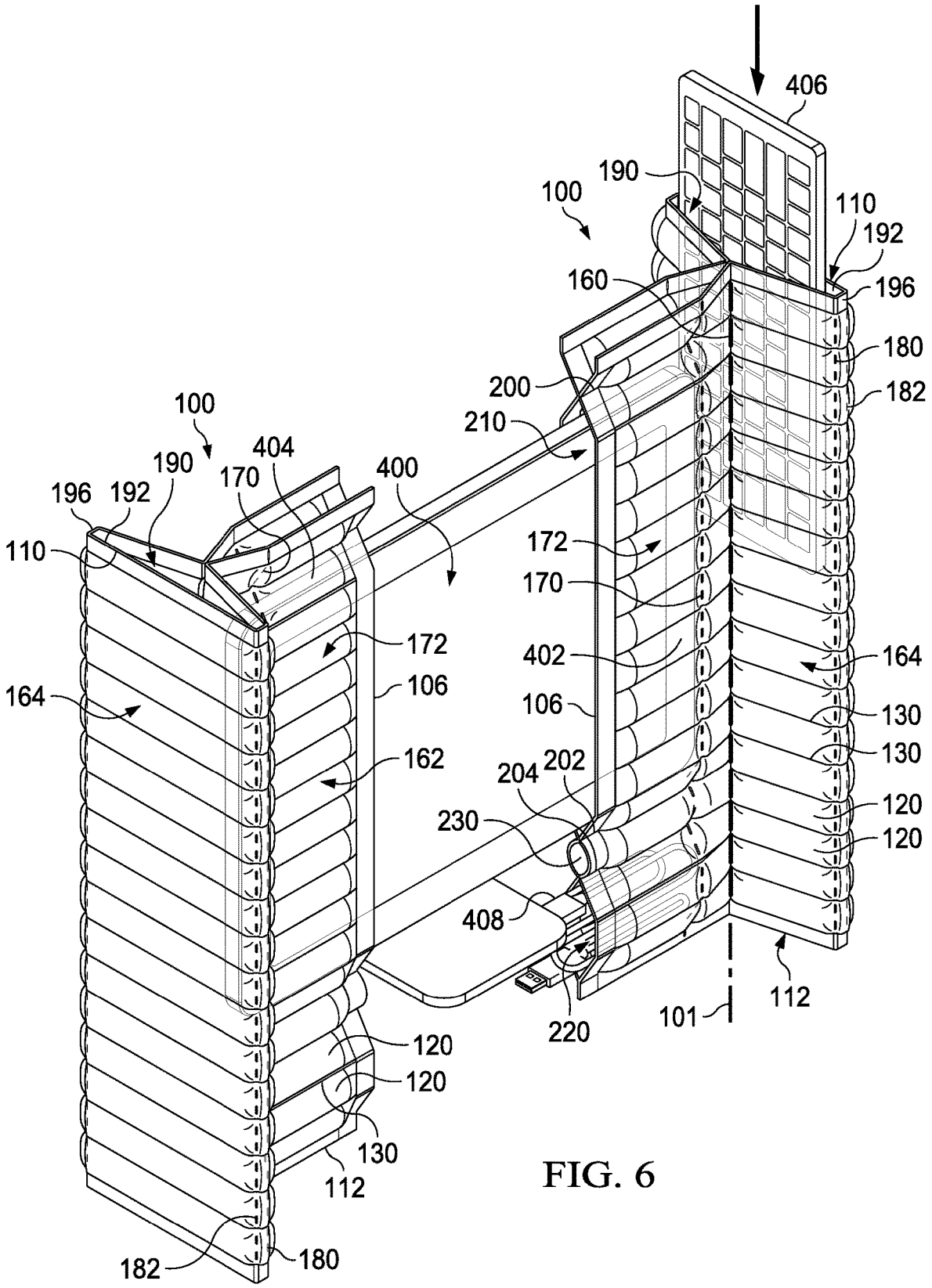
FIG. 6 is a simplified pictorial illustration of the protected screen of FIGS. 5A & 5B, showing additionally insertion of accessories into portions of the end panels of FIGS. 3A-3D.

Reference is now made to FIG. 6, which is a simplified pictorial illustration of the protected screen of FIGS. 5A & 5B, showing additionally insertion of accessories into portions of the end panels of FIGS. 3A-3D.

The sides of screen 400 are inserted into second openings 210 of the end panels 100 in FIG. 6, as previously shown in FIGS. 5A & 5B. Additionally, it is now seen that a keyboard 406 is inserted into the first opening 190 of one of the end panels 100, particularly, the keyboard is inserted into the rectangular portion 192 of the first opening 190.

It is further seen that accessories, such as an electrical cord 408 are inserted into the third opening 220 and the buffer air compartment 230 separates the cord 408 from the screen 400. It is noted that additional accessories, such as a mouse for example, can be inserted into third opening 220 of the second end panel 100, which receives side 404 of the screen 400.

Figure 7:
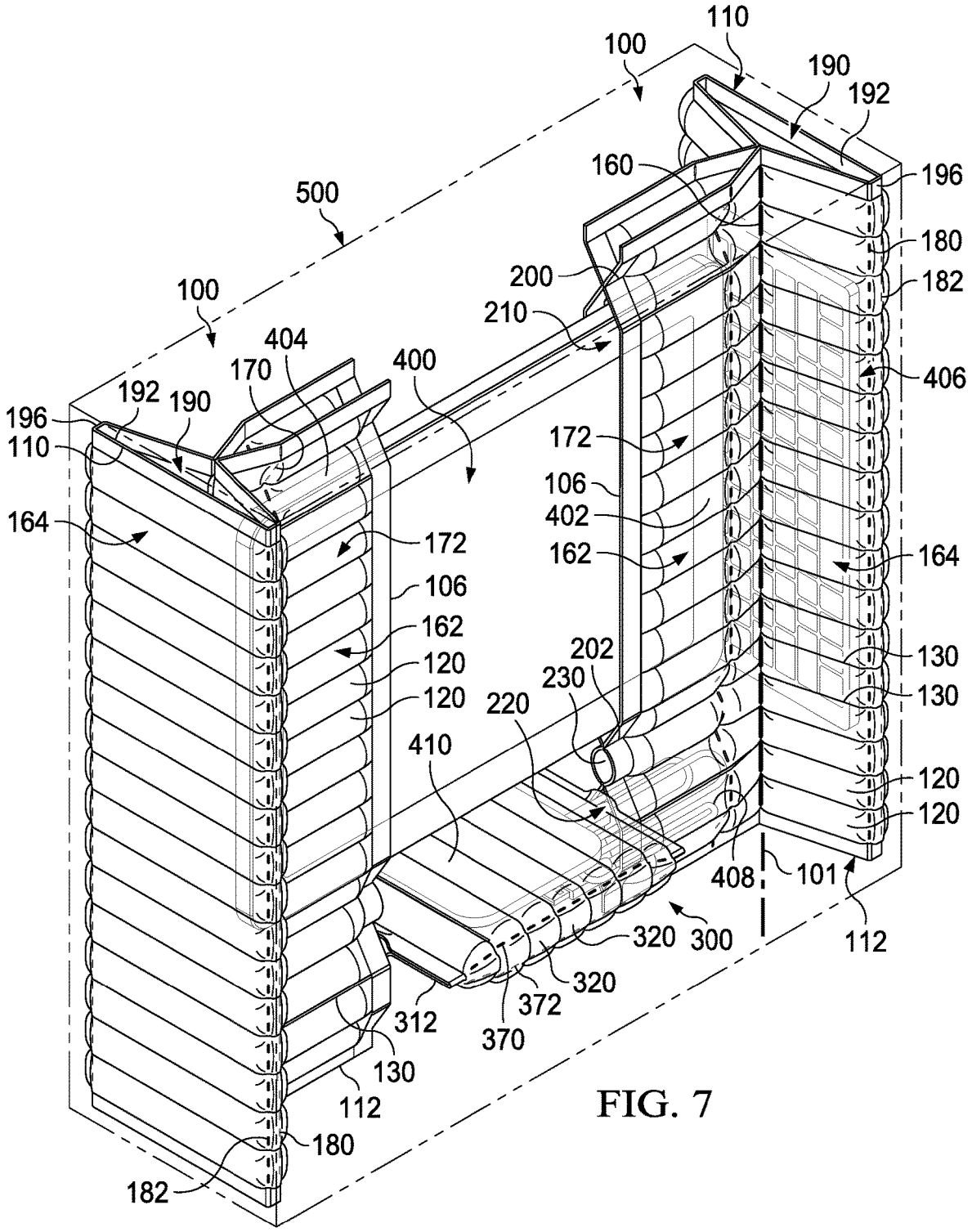
FIG. 7 is a simplified pictorial illustration of the protected screen and accessories as shown in FIG. 6, additionally showing protection of the base of the screen by the foot panel of FIGS. 4A-4D and the electronic device protected by the entire packaging structure inserted into a box.

Reference is now made to FIG. 7, which is a simplified pictorial illustration of the protected screen and accessories as shown in FIG. 6, additionally showing protection of the base of the screen by the foot panel of FIGS. 4A-4D and the electronic device protected by the entire packaging structure inserted into a box.

It is a particular feature of an embodiment of the present invention that both the end panels 100 and the foot panel 300 are shipped flat and inflated on demand.

It is noted that the inflatable packaging structure in accordance to an embodiment of the present invention as described with reference to FIGS. 1A-4D, enables an increase in drop resistance by at least 30% as compared with other known packaging structures.

The sides of screen 400 are inserted into second openings 210 of the end panels 100 in FIG. 7, as previously shown in FIG. 6. The keyboard 406 is now inserted into the first opening 190 of one of the end panels 100. The electrical cord 408 and the mouse are inserted each into its respective third opening 220 in two identical end panels 100.

It is a particular feature of an embodiment of the present invention that the base of the screen 410 is at least partially received within opening 390 of the foot panel 300 and the long portion 316 of the foot panel is folded over the other portion of the base of the screen 410 by folding the foot panel 300 using the weld line 318. The foot panel 300 is designed such that the length defined between edge 310 and 312 of the foot panel 300 equals at least the length by which the two identical end panels 100 are spaced from each other, namely the foot panel 300 occupies the entire space remaining between the two end panels 100. The foot panel 300 serves for two different functions: the foot panel 300 keeps the accessories, such as the electrical cord 408 and the mouse safely within the third openings 220 of the end panels 100 and prevents inadvertent removal of these accessories from the openings 220; the foot panel 300 additionally aligns the end panels 100 at their respective places and thereby provides for an increased shock absorbance.

It is a further particular feature of an embodiment of the present invention that the air chambers 120 disposed between edge 112 and weld line 202 separate the screen 400 from the walls of a box 500 and thus provides for increased rigidity shock absorbance, both due to the buffer air compartment 230 and due to additional air chambers 120 which form the third opening 220 of the end panels 100 and separate the screen 400 from the wall of the box 500. The foot panel 300 provides for an additional protection by further separating the entire protected structure, i.e. the screen 400, the keyboard 406, the electrical cord 408 and the mouse from the walls of the box 500. Similarly, the air chamber formed between edge 310 and weld line 200 of each of the end panels 100 separates the protected structure from the upper wall of the box 500. It is additionally noted that the foot panel 300 eliminates shock transfer to the protected device.

It is a further particular feature of the present invention that the second receiving portions 164 of the end panels 100 are adapted both for receiving the keyboard 406 and for separating the protected structure from the side walls of the box 500.

It is noted that the end panels 100 and the foot panel 300 are used for distancing the protected device, such as a screen, laptop, etc, from the sides, top and bottom walls of the box 500 by suspending the packaged device in the center of the box. The properties of the inflatable packaging structure as described in detail hereinabove enable to protect the computer/TV screen/laptop and aid sustaining a series of repeated drops which can occur during handling and delivery of the computer/TV/laptop.

It is appreciated by the person skilled in the art that the weld lines as described hereinabove, can alternatively be disposed in different locations of the end panel 100 or the foot panel 300, that would enable the same functionality of the packaging structure.

It will be appreciated by persons skilled in the art that the present invention is not limited by what has been particularly shown and described hereinabove. Rather the scope of the present invention includes both combinations and subcombinations of various features described hereinabove as well as variations and modifications thereof which are not in the prior art.

The invention claimed is:

1. An inflatable packaging structure, comprising:

at least one end panel made of a plurality of layers of thermoplastic material and arranged along a longitudinal axis;

said at least one end panel includes a plurality of fluid chambers arranged perpendicularly to said longitudinal axis, whereas a one-way check valve is incorporated into at least one of said plurality of fluid chambers;

an air supply line, configured to commonly communicate with each of said one-way check valves to supply fluid into said fluid chambers; and a plurality of weld lines formed through at least two of said plurality of layers of thermoplastic material and configured to form at least three openings within said at least one end panel when said fluid is supplied into said plurality of fluid chambers, and wherein at least one of said at least three openings extends in parallel to said longitudinal axis and at least two of said at least three openings extend perpendicularly to said longitudinal axis and wherein said at least two of said at least three openings face the same direction.

2. The inflatable packaging structure according to claim 1, and wherein at least one of said plurality of weld lines is adapted to join two of said plurality of layers of thermoplastic material.

3. The inflatable packaging structure according to claim 1, and wherein at least one of said plurality of weld lines is adapted to join four of said plurality of layers of thermoplastic material.

4. The inflatable packaging structure according to claim 1, and wherein at least two of said weld lines are perpendicular to each other.

5. The inflatable packaging structure according to claim 1, and also comprising a second end panel, which is identical to the at least one panel.

6. The inflatable packaging structure according to claim 1, and also comprising a foot panel having an opening.

7. The inflatable packaging structure according to claim 6, and wherein said foot panel is adapted to be inserted between two end panels.

8. The inflatable packaging structure according to claim 1, and wherein a fluid buffer chamber is formed between said at least two of said at least three openings.

9. The inflatable packaging structure according to claim 1, and wherein at least one of said at least three openings has an at least partially rectangular cross-section.

10. The inflatable packaging structure according to claim 1, and wherein a first opening of said at least three openings of said end panel is adapted for receiving a portion of a screen thereinto.

11. The inflatable packaging structure according to claim 10, and wherein a second opening of said at least three openings, which is perpendicular to said first opening, is adapted for receiving a keyboard thereinto.

12. The inflatable packaging structure according to claim 10, and wherein a third opening of said at least three openings, which is facing the same direction as the first opening is adapted to receive an electrical cord thereinto.

13. The inflatable packaging structure according to claim 6, and wherein said opening of said foot panel is adapted to receive a base of a screen thereinto.

14. An inflatable packaging structure, comprising:

at least one end panel made of a plurality of layers of thermoplastic material and arranged along a longitudinal axis;

said at least one end panel includes a plurality of fluid chambers arranged perpendicularly to said longitudinal axis, whereas a one-way check valve is incorporated into at least one of said plurality of fluid chambers;

an air supply line, configured to commonly communicate with each of said one-way check valves to supply fluid into said fluid chambers; and a plurality of weld lines extending in parallel to each other and adapted to join four layers of said plurality of layers of thermoplastic material and configured to form at least two portions, whereas one of said at least two portions is pivotable about one of said plurality of weld lines when said fluid is supplied into said plurality of fluid chambers.

15. The inflatable packaging structure according to claim 14 and wherein said plurality of weld lines are configured to form at least two openings within said at least one end panel when said fluid is supplied into said plurality of fluid chambers.

16. The inflatable packaging structure according to claim 15, and wherein said two openings are directed perpendicularly with respect to each other.

17. An inflatable packaging kit, comprising:

at least two end panels and a foot panel, each made of a plurality of layers of thermoplastic material and arranged along a longitudinal axis, wherein each of said at least two end panels and said foot panel includes a plurality of fluid chambers arranged perpendicularly to said longitudinal axis, whereas a one-way check valve is incorporated into at least one of said plurality of fluid chambers; an air supply line, configured to commonly communicate with each of said one-way check valves to supply fluid into said fluid chambers; and a plurality of weld lines extending in parallel to each other and adapted to join four layers of said plurality of layers of thermoplastic material and configured to form at least two portions, whereas one of said at least two portions is pivotable about one of said plurality of weld lines when said fluid is supplied into said plurality of fluid chambers;

the at least two end panels and said foot panel are configured to be inflated and said foot panel is adapted to be inserted between said at least two end panels when inflated, thereby positioning the at least two end panels with respect to a packaging box.

18. The inflatable packaging kit according to claim 17 and wherein said plurality of weld lines are configured to form at least two openings within at least one of said at least two end panels when said fluid is supplied into said plurality of fluid chambers, and wherein said two openings are directed perpendicularly with respect to each other.

* * * * *